US009373892B2

(12) United States Patent
Yatabe et al.

(10) Patent No.: US 9,373,892 B2
(45) Date of Patent: Jun. 21, 2016

(54) DIELECTRIC WAVEGUIDE SLOT ANTENNA

(75) Inventors: Yukikazu Yatabe, Tsurugashima (JP); Kazuhiro Ito, Tsurugashima (JP)

(73) Assignee: TOKO, INC., Saitama (JP)

( * ) Notice: Subject to any disclaimer, the term of this patent is extended or adjusted under 35 U.S.C. 154(b) by 486 days.

(21) Appl. No.: 13/236,236

(22) Filed: Sep. 19, 2011

(65) Prior Publication Data

US 2012/0068900 A1 Mar. 22, 2012

(30) Foreign Application Priority Data

Sep. 17, 2010 (JP) ..... 2010-208977

(51) Int. Cl.
*H01Q 13/10* (2006.01)

(52) U.S. Cl.
CPC ..... *H01Q 13/10* (2013.01)

(58) Field of Classification Search
CPC ..... H01Q 13/10; H01Q 13/18
USPC ..... 343/767, 772, 768–771
See application file for complete search history.

(56) References Cited

U.S. PATENT DOCUMENTS 4,958,165 A * 9/1990 Axford ..... H01Q 13/18 343/770
5,030,965 A 7/1991 Park et al.
6,147,647 A * 11/2000 Tassoudji ..... H01Q 9/0492 333/219.1
7,541,998 B1 * 6/2009 Chang et al. ..... 343/767
8,599,090 B2 12/2013 Yamaguchi et al.
2010/0321265 A1 * 12/2010 Yamaguchi ..... H01Q 13/22 343/771

FOREIGN PATENT DOCUMENTS

| | | | |
|---|---|---|---|
| JP | 03-141706 | | 6/1991 |
| JP | 03-173204 | | 7/1991 |
| JP | 2004201163 A | * | 7/2004 |
| JP | 2004-221714 | | 8/2004 |
| JP | 2005-217865 | | 8/2005 |
| JP | 2005217865 A | * | 8/2005 |
| WO | WO 2009/107216 | | 9/2009 |

* cited by examiner

*Primary Examiner* — Dameon E Levi
*Assistant Examiner* — Hasan Islam
(74) *Attorney, Agent, or Firm* — Cozen O'Connor

(57) ABSTRACT

A dielectric waveguide slot antenna which is capable of radiating a circularly-polarized wave comprises: a dielectric waveguide having a slot through which a dielectric is exposed in a part of an electrically conductive film formed on a surface of the dielectric waveguide; a printed circuit board having a via hole opposed to the slot with the same shape as that of the slot; and a conductor plate having a first through-hole opposed to and having approximately the same shape as the via hole, and a pair of second through-holes in a vicinity of the first through-hole. The dielectric waveguide, the printed circuit board and the conductor plate are joined together with aligning the slot, the via hole and the first through-hole with each other. The printed circuit board has a conductor layer formed in positions facing to the second through-holes, and the second through-holes are arranged point-symmetrically with each other.

3 Claims, 6 Drawing Sheets xz-pl.

( a )

yz-pl.

( b )

Prior Art

DIELECTRIC WAVEGUIDE SLOT ANTENNA

TECHNICAL FIELD

The present invention relates to a slot antenna designed to be fed by a dielectric waveguide in microwave and millimeter-wave bands, and, more specifically, to a dielectric waveguide slot antenna capable of radiating a circularly-polarized wave with a simple structure.

BACKGROUND ART

As an antenna utilizing a dielectric waveguide as one type of transmission line, a dielectric waveguide slot antenna has been proposed. The dielectric waveguide slot antenna is suitable for use in microwave and millimeter-wave bands. FIG. 9 is an exploded perspective view illustrating a conventional dielectric waveguide slot antenna.

As illustrated in FIG. 9, the conventional dielectric waveguide slot antenna comprises a dielectric waveguide 100 having a slot 110 through which a dielectric is exposed from a bottom surface thereof. The dielectric waveguide 100 is mounted on a printed circuit board 200 formed with a via hole 210 having approximately the same shape as that of the slot 110 at a position opposed to the slot 110, and a conductor plate 300 having a first through-hole 310 at a position opposed to the via hole 210 is joined to the printed circuit board 200.

The conventional dielectric waveguide slot antenna illustrated in FIG. 9 is structurally simple, and capable of obtaining wideband characteristics even based on a single slot, so that it has high availability.

PRIOR ART DOCUMENTS

Patent Documents

Patent Document 1: JP 2004-221714A
Patent Document 2: JP 03-173204A

SUMMARY OF THE INVENTION

Problem to be Solved by the Invention

Generally, in terms of polarized wave dependence, receiving sensitivity is less likely to depend on a circularly-polarized wave as compared with a linearly-polarized wave. Thus, in use for a device in which a receiving position is continually changed, such as a mobile communication terminal, it is desirable to utilize a circularly-polarized wave, rather than a linearly-polarized wave. However, the dielectric waveguide slot antenna illustrated in FIG. 9 has a restriction that it is capable of radiating only a linearly-polarized wave.

As means to allow a slot antenna to radiate a circularly-polarized wave, there have been known a technique of combining two or more antennas different in direction and phase of a polarized wave, and a technique of providing a plurality of slots in a waveguide.

The above techniques leads to the following problems: an increase in size of an antenna system, associated with formation of a feeder circuit such as a branch circuit, and an increase in size of a waveguide due to a need for antenna array. Thus, they have difficulty in applying to a device requiring reductions in weight, thickness and cost, such as a mobile communication terminal, which hinders widespread use of a waveguide-type circularly-polarized antenna.

The present invention is directed to providing a dielectric waveguide slot antenna capable of radiating a circularly-polarized wave with a simple structure.

Means for Solving the Problem

In order to solve the above problems, according to one aspect of the present invention, there is provided a dielectric waveguide slot antenna which comprises: a dielectric waveguide having a slot through which a dielectric is exposed in a part of an electrically conductive film formed on a surface of the dielectric waveguide; a printed circuit board having a via hole formed therein at a position opposed to the slot, the via hole having approximately the same shape as that of the slot; and a conductor plate having a first through-hole formed therein at a position opposed to the via hole, and a pair of second through-holes in a vicinity of the first through-hole, wherein: the dielectric waveguide, the printed circuit board and the conductor plate are joined together with aligning the slot, the via hole and the first through-hole with each other; the printed circuit board has a conductor layer formed in positions facing to the second through-holes; and the second through-holes are arranged point-symmetrically with each other with respect to the center of the first through-hole, and rotated with respect to the longitudinal direction of the first through-hole.

Effect of the Invention

The dielectric waveguide slot antenna of the present invention is capable of radiating a circularly-polarized wave with a simple structure prepared by stacking the dielectric waveguide, the printed board and the conductor plate together and forming the plurality of through-holes in the conductor plate, so that it can be offered for use in a device requiring reductions in weight and thickness, such as a mobile communication terminal.

DESCRIPTION OF EMBODIMENTS

Figure 1:
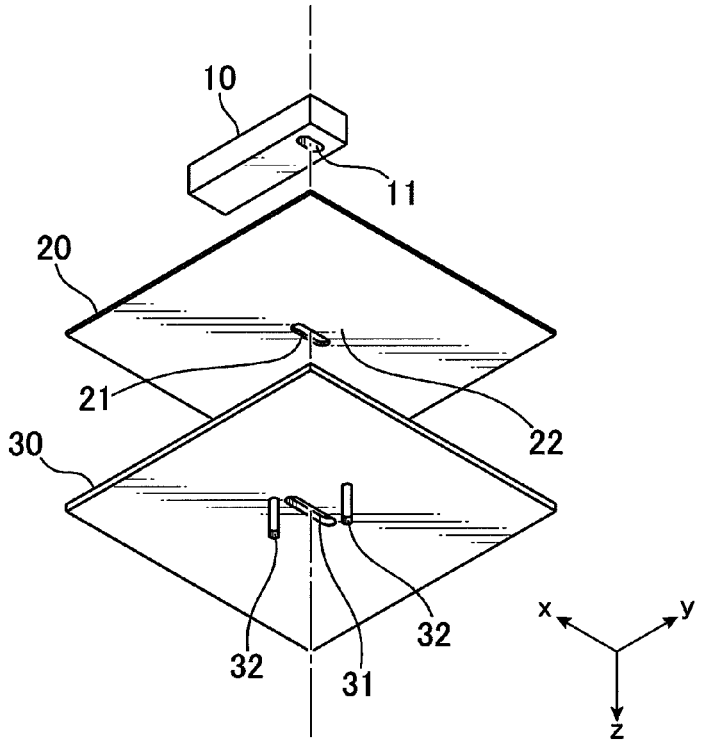
FIG. 1 is an exploded perspective view illustrating a structure of a dielectric waveguide slot antenna according to one embodiment of the present invention.

A dielectric waveguide slot antenna of the present invention will now be described based on an embodiment thereof FIG. 1 is an exploded perspective view of a dielectric waveguide slot antenna according to one embodiment of the present invention.

As illustrated in FIG. 1, the dielectric waveguide slot antenna comprises a dielectric waveguide 10, a printed circuit board 20, and a conductor plate 30. The dielectric waveguide 10 comprises a dielectric, an electrically conductive film formed on a surface of the dielectric, and a slot 11 through which the dielectric is exposed from a part of the electrically conductive film. The printed circuit board 20 is formed with a via hole 21 having approximately the same shape as that of the slot 11 at a position opposed to the slot 11. The conductor plate 30 is formed with a first through-hole 31 having approximately the same shape as that of the via hole 21 at a position opposed to the via hole 21, and a pair of second through-holes 32, 32 in a vicinity of the first through-hole 31. The dielectric waveguide 10 is mounted on the printed circuit board 20 which is joined to conductor plate 30.

The slot 11 is provided such that a longitudinal direction thereof is oriented perpendicular to a longitudinal direction of the dielectric waveguide (propagation direction of an electromagnetic wave).

Each of the via hole 21 and the first through-hole 31 has approximately the same shape as that of the slot 11. However, in view of enhancing radiation efficiency with respect to a free space, it is preferable that the via hole 21 has a longitudinal length greater than a longitudinal length of the slot 11, and the first through-hole 31 has a longitudinal length greater than the longitudinal length of the via hole 21.

Each of the pair of second through-holes 32, 32 is an elongate hole, and they are arranged in point-symmetrical relation with respect to a center point of the first through-hole 31. A longitudinal direction of the second through-hole 32 is inclined at about 45° with respect to a longitudinal direction of the first through-hole 31, and a distance between the center of the first through-hole 31 and a center of the second through-hole 32 is less than a half wavelength of a frequency to be used.

The dielectric waveguide 10, the printed circuit board 20 and the conductor plate 30 are stacked and joined together in such a manner that the slot 11, the via hole 21 and the first through-hole 31 are aligned with each other in terms of their center positions and longitudinal directions.

The printed circuit board 20 has a conductor layer 22 formed in positions facing to the second through-holes.

Figure 2:
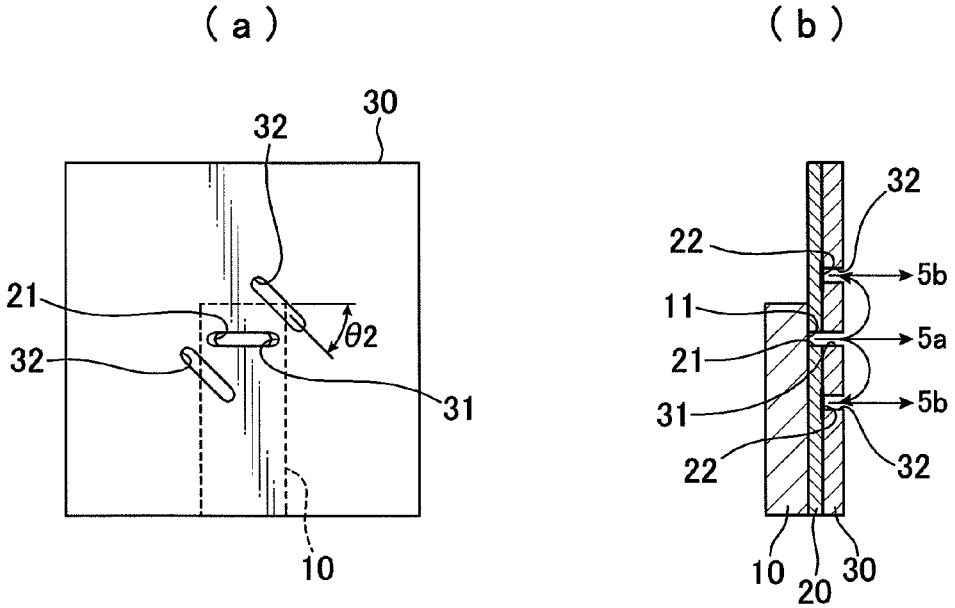
FIG. 2 illustrates an operation of the dielectric waveguide slot antenna according to the embodiment.

FIG. 2 illustrates a principle of operation of the dielectric waveguide slot antenna according to the embodiment, wherein FIG. 2(*a*) is a top plan view, and FIG. 2(*b*) is a schematic sectional view.

In cases where the through-holes 31, 32, 32 are located adjacent to the slot 11, it is considered that a direct wave 5*a* directly radiated from the first through-hole 31 combines indirect waves 5*b*,5*b* which are a part of direct wave 5*a* reradiated from the second through-holes 32, 32 through the conductor layer 22 provided on a surface of the printed circuit board 20, so as to control directivity, as illustrated in FIG. 2(*b*).

Usually, in order to uniform respective polarization directions of the direct wave 5*a* and each of the indirect waves 5*b* so as to facilitate interference between the direct wave 5*a* and the indirect wave 5*b*, respective longitudinal directions of the second through-hole 32 and the slot 11 are arranged in parallel. Differently, in the dielectric waveguide slot antenna according to this embodiment, the longitudinal direction of the second through-hole 32 is disposed to be rotated by a rotation angle θ2 with respect to a longitudinal direction of the first through-hole 31, as illustrated in FIG. 2(*a*).

In cases where the longitudinal direction of the second through-hole 32 is not parallel to the longitudinal direction of the first through-hole 31, the indirect wave 5*b* to be reradiated from the second through-hole 32 is evaluated by resolving it into a component parallel to a polarized wave based on the direct wave 5*a* and a component perpendicular to the polarized wave based on the direct wave 5*a*. A combined wave is composed of the following two:

(a) a combination of "a component included in the indirect wave, parallel to the polarized wave based on the direct wave 5*a*" and "the direct wave"; and (b) "a component included in the indirect wave, perpendicular to the polarized wave based on the direct wave 5*a*".

The two components (a) and (b) are perpendicular to each other. Thus, the combined wave can be formed as an optimal circularly-polarized wave by designing the antenna such that the components (a) and (b) have the same amplitude and a phase difference of 90°. An amplitude and phase of the indirect wave 5*b* are adjusted based, for example, on a shape and position of the second through-hole 32.

In cases where the longitudinal direction of the first through-hole 31 and the longitudinal direction of the second through-hole 32 are perpendicular to each other (θ2 =−90° or 90°), or parallel to each other (θ2=0°), no component parallel or perpendicular to the polarized wave based on the direct wave is included in the indirect wave, so that the combined wave is not formed as a circularly-polarized wave. Preferably, θ2 is set to 45° or −45°.

A rotation direction of a circularly-polarized wave is determined by a direction of the rotation angle θ2 of the second through-hole 32. On an assumption that a clockwise direction when seeing the conductor plate 30 from a radiation direction is a positive direction, and −90°<θ2<90°, a right-handed circularly-polarized wave is formed when θ2>0, and a left-handed circularly-polarized wave is formed when θ2<0.

Figure 3:
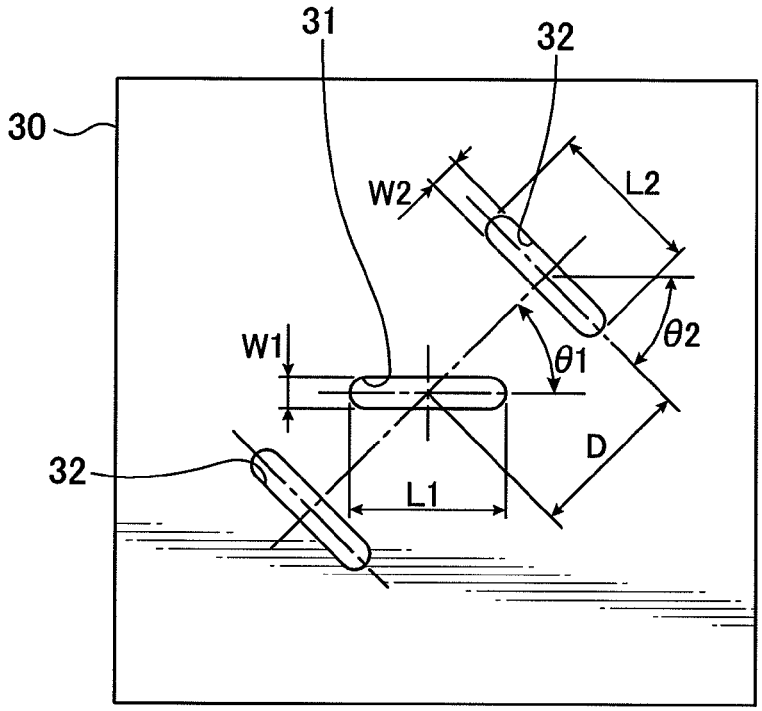
FIG. 3 is a top plan view illustrating a first through-hole and second through-holes.

FIG. 3 is a top plan view illustrating respective positions of the first through-hole 31 and the second through-holes 32, 32 arranged in the conductor plate 30.

As illustrated in FIG. 3, the pair of second through-holes 32, 32 are arranged in point-symmetrical relation with respect to the center point of the first through-hole 31. The first through-hole 31 is a linear-shaped elongate hole having a length L1×a width W1, and each of the second through-holes 32 is a linear-shaped elongate hole having a length L2×a width W2. The second through-hole 32 has a center point which is rotated by a rotation angle θ1 with respect to the longitudinal direction of the first through-hole 31 and spaced apart from the center point of the first through-hole 31 by a distance D. Further, the second through-hole 32 is rotated about the center point of the second through-hole 32 by the rotation angle θ2 with respect to the longitudinal direction of the first through-hole 31.

EXAMPLE 1

The dielectric waveguide slot antenna was prepared under the following conditions.

A size of the dielectric waveguide 10: width 2.5 mm×height 1.2 mm×length 10 mm A relative permittivity ∈r of a dielectric material: 2.31

A position of the slot 11: 1.8 mm from an end of the dielectric waveguide

A size of the slot: length 2.1 mm×width 1.0 mm

A size of the conductor plate 30: length 20 mm×width 20 mm×thickness 1.0 mm

A size of the printed circuit board 20: length 20 mm×width 20 mm×thickness 0.2 mm A size of the first through-hole 31: L1×W1=2.7 mm×1.0 mm A size of the second through-hole 32: L2×W2=3.8 mm×1 mm The rotation angle θ1 of the second through-hole 32 with respect to the first through-hole 31: 45°

Figure 4:
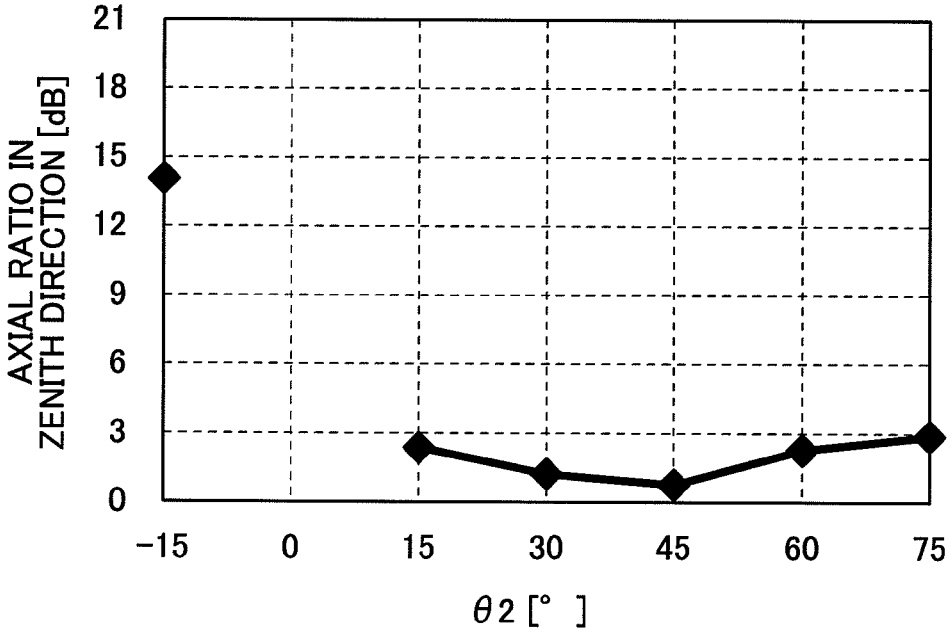
FIG. 4 is a graph illustrating an axial ratio in a zenith direction, depending on a rotation angle θ2 of the second through-hole, in an inventive example.

The distance D between the second through-hole 32 and the first through-hole 31: 1.95 mm FIG. 4 is a result obtained by calculating an axial ratio in a zenith direction using an electromagnetic simulator, when the rotation angle θ2 of the second through-hole 32 is changed under the above conditions. In FIG. 4, the horizontal axis represents the rotation angle θ2, and the vertical axis represents the axial ratio [dB] in the zenith direction. A frequency used is 61 GHz.

As seen in FIG. 4, a right-handed circularly-polarized wave having an optimal axial ratio was obtained when θ2=about 45°.

EXAMPLE 2

Figure 5:
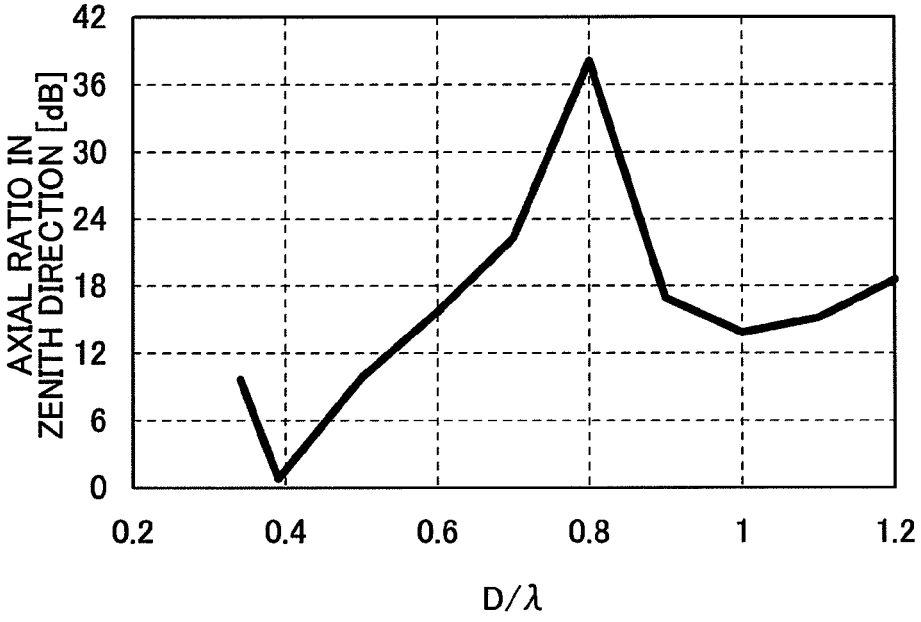
FIG. 5 is a graph illustrating an axial ratio in the zenith direction, depending on a distance D between the first through-hole and the second through-hole, in an inventive example.

FIG. 5 is a result obtained by calculating an axial ratio in the zenith direction using an electromagnetic simulator, when the rotation angle θ2 of the second through-hole 32 is fixed to 45°, and the distance D of the second through-hole 32 with respect to the first through-hole 31 is changed, differently from Example 1. The remaining conditions are the same as those in Example 1. In FIG. 5, the horizontal axis represents a ratio of the distance D/a wavelength λ, and the vertical axis represents the axial ratio [dB] in the zenith direction.

As seen in FIG. 5, an axial ratio characteristic is sharply deteriorated when the distance D of the second through-hole 32 with respect to the first through-hole 31 becomes greater than 0.5 times the wavelength λ of the frequency used.

EXAMPLE 3

Figure 6:
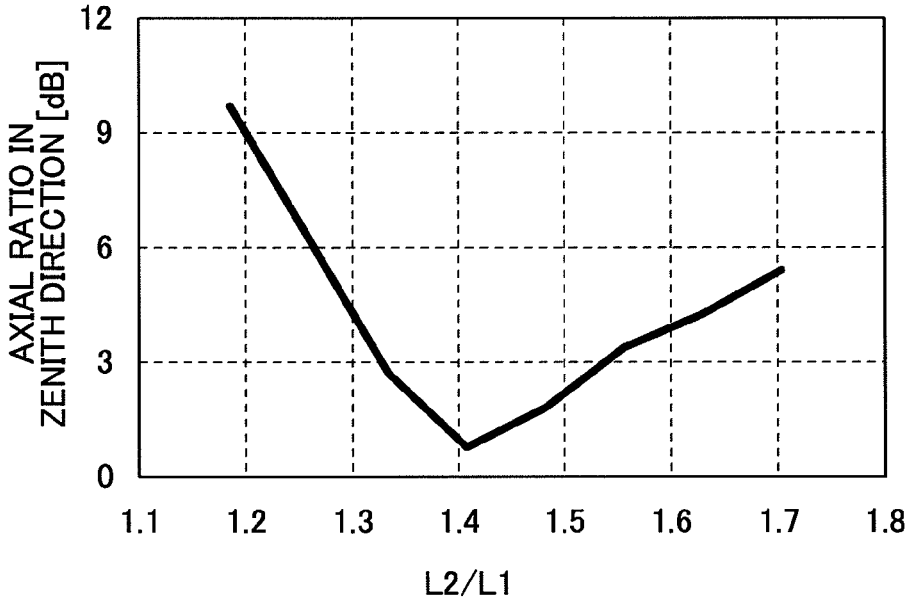
FIG. 6 is a graph illustrating an axial ratio in the zenith direction, depending on a length L2 of the second through-hole, in an inventive example.

FIG. 6 is a result obtained by calculating an axial ratio in the zenith direction using an electromagnetic simulator, when the rotation angle θ2 of the second through-hole 32 is fixed to 45°, and the length L2 of the second through-hole 32 is changed, differently from Example 1. The remaining conditions are the same as those in Example 1. In FIG. 6, the horizontal axis represents a ratio of the longitudinal length L2 of the second through-hole 32/the longitudinal length L1 of the first through-hole 31, and the vertical axis represents the axial ratio [dB] in the zenith direction.

As seen in FIG. 6, an optimal axial ratio can be obtained when the longitudinal length L2 of the second through-hole 32 is about 1.4 times the longitudinal length L1 of the first through-hole 31.

EXAMPLE 4

Figure 7:
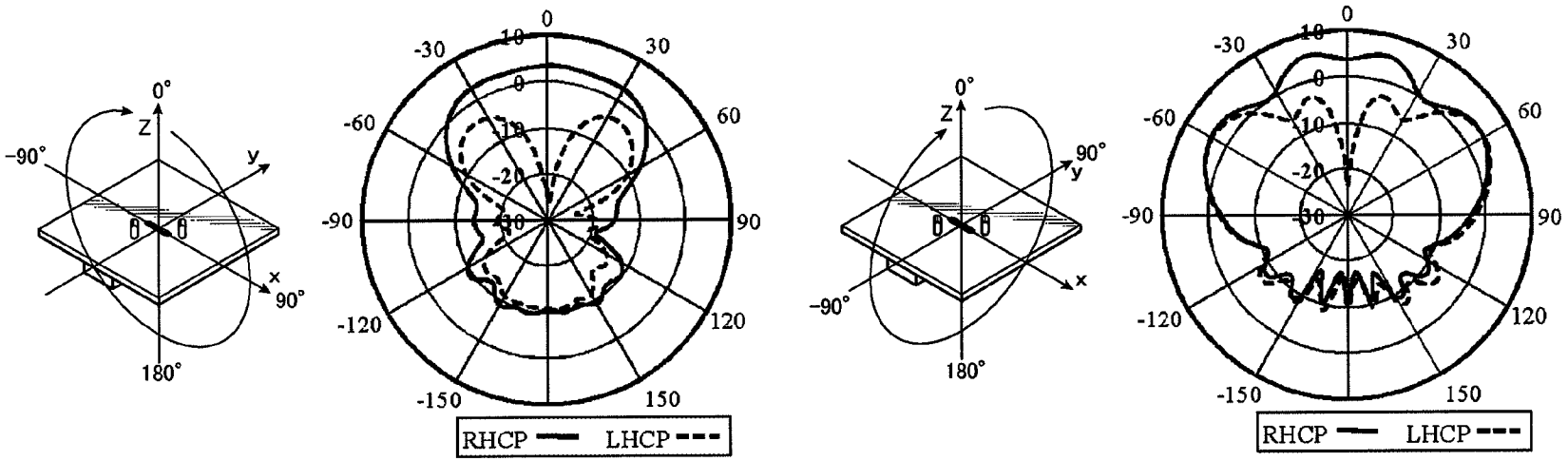
FIG. 7 graphically illustrates radiation characteristics of a dielectric waveguide slot antenna in an inventive example.

FIG. 7 is a result obtained by calculating radiation characteristics using an electromagnetic simulator, when the rotation angle θ2 of the second through-hole 32 is fixed to 45°, and the rotation angle θ2 of the second through-hole 32 is changed, differently from Example 1. The remaining conditions are the same as those in Example 1.

FIG. 7(*a*) illustrates a right-handed circularly-polarized wave (RHCP) and a left-handed circularly-polarized wave (LHCP) on an X-Z plane, and FIG. 7(*b*) illustrates a right-handed circularly-polarized wave (RHCP) and a left-handed circularly-polarized wave (LHCP) on a Y-Z plane, on an assumption that a surface of the conductor plate 30 is an X-Y plane, and the longitudinal direction of the first through-hole 31 and a radiation direction of an electromagnetic wave are an X-axis direction and a Z-axis direction, respectively.

As seen in FIG. 7, an excellent circularly-polarized wave can be obtained.

As is evidenced from the results of Examples 1 to 4, a dielectric waveguide slot antenna capable of obtaining an optimal circularly-polarized wave is provided by: arranging the second through-holes 32, 32 in point-symmetrical relation with respect to the center point of the first through-hole 31 while being rotated by about 45° with respect to the longitudinal direction of the first through-hole 31; setting the distance between the center point of the first through-hole 31 and the second through-hole 32, to a value less than a half wavelength of a frequency to be used; and setting the longitudinal length of the second through-hole 32 to a value about 1.4 times the longitudinal length of the first through-hole 31.

In Examples 1 to 4, the second through-hole 32 was disposed to have a rotation angle θ2 of 45°, so that a right-handed circularly-polarized wave was obtained. When the second through-hole 32 is disposed to have a rotation angle θ2 of −45°, a left-handed circularly-polarized wave is obtained.

Figure 8:
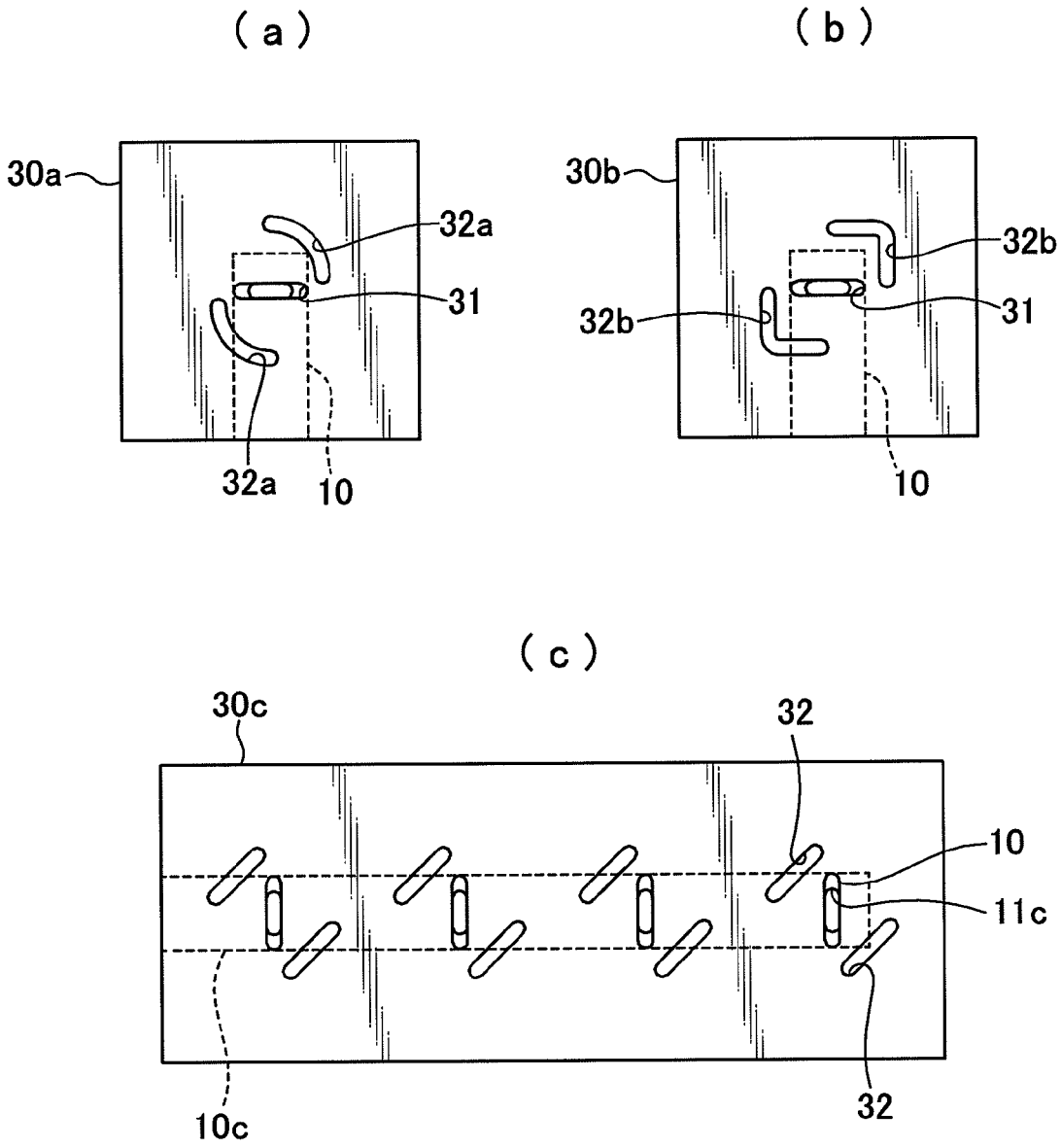
FIG. 8 illustrates other embodiments of the present invention.
Figure 9:
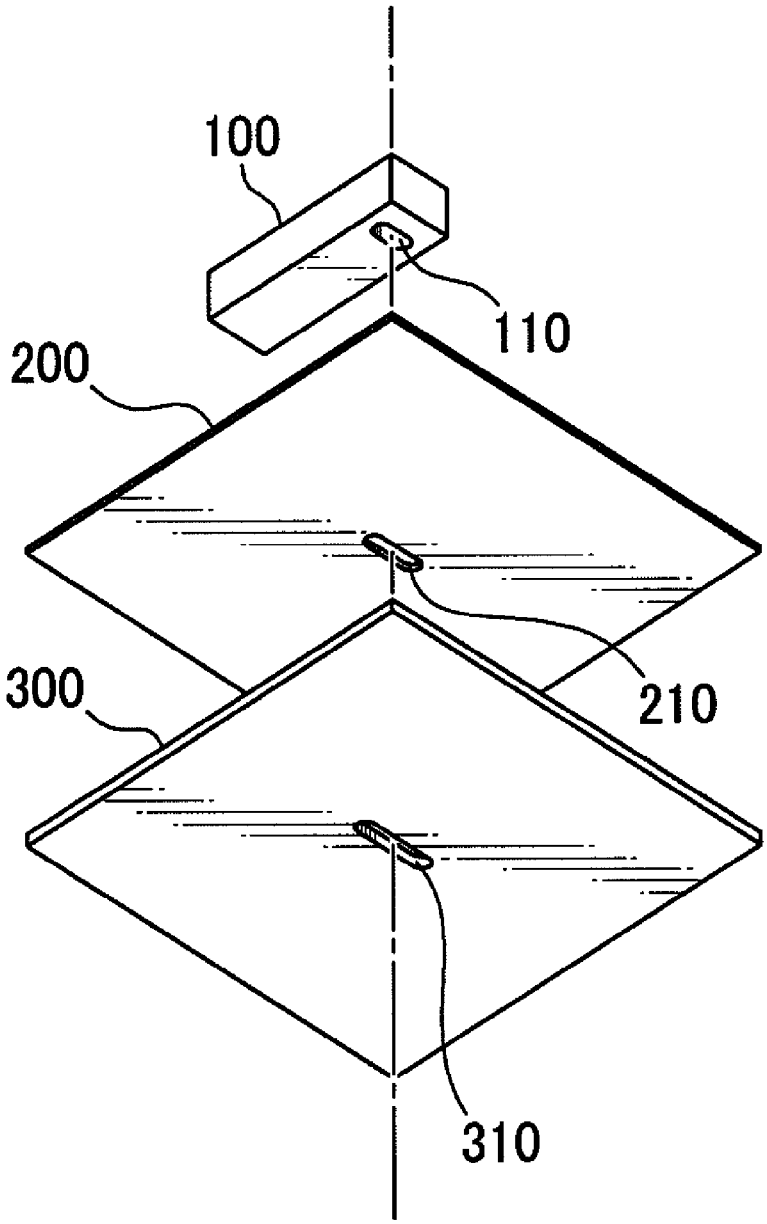
FIG. 9 is an exploded perspective view illustrating a conventional dielectric waveguide slot antenna.

The second through-hole is not limited to a linear-shaped elongate hole, but may be an arc-shaped or bended elongate hole. FIG. 8 illustrates other embodiments of the present invention.

The second through-hole may be formed as an arc-shaped second through-hole 32*a*, as illustrated in FIG. 8(*a*), or a dogleg-shaped second through-hole 32*b*, as illustrated in FIG. 8(*b*). In this case, an area occupied by the second through-hole on the conductor plate can be reduced. Further, as illustrated in FIG. 8(*c*), a plurality of slots 11*c* may be provided in a dielectric waveguide, and a first through-hole 31*c* and a second through-hole 32*c* may be provided in a conductor plate 30*c* in an array arrangement. In this case, a gain and directivity of a dielectric waveguide slot antenna can be enhanced.

The conductor plate may be replaced, for example, by a printed circuit board, or a metal-plated resin plate. Each of the second through-holes may be a groove which does not penetrate through the conductor plate. In this case, a combined wave can also be formed as a circularly-polarized wave, because an indirect wave is reflected by a bottom of the groove.

The dielectric waveguide slot antenna of the present invention can be obtained simply by modifying a structure of a conventional dielectric waveguide slot antenna, so that a conventional dielectric waveguide can be used therefor. This makes it possible to provide a dielectric waveguide slot antenna for a circularly-polarized wave while suppressing a production cost, without a need for designing a dielectric waveguide for circularly-polarized waves, separately from a dielectric waveguide for linearly-polarized waves.

EXPLANATION OF REFERENCES

10, 100: dielectric waveguide
11, 11*c*, 110: slot
20, 200: printed circuit board
21, 210: via hole
22: conductor layer
30, 30*a* to 30*c*, 300: conductor plate
31, 310: first through-hole
32, 32*a* to 32*c*: second through-hole
5*a*: direct wave
5*b*: reflected wave

What is claimed is:

1. A dielectric waveguide comprising:

a dielectric waveguide having a slot of elongate shape through which a dielectric is exposed in a part of an electrically conductive film formed on a surface of the dielectric waveguide;

a printed circuit board having a via hole of elongate shape formed therein at a position opposed to the slot; and a conductor plate having a first through-hole of elongate shape formed therein at a position opposed to the via hole, and a pair of second through-holes of elongate shape formed in a vicinity of the first through-hole, wherein the first through-hole and the second through-holes are in the same plane;

wherein the first through-hole is fed with electric power while the second through-holes are not fed with electric power;

wherein the dielectric waveguide, the printed circuit board and the conductor plate are joined together with aligning the slot, the via hole and the first through-hole with each other;

wherein the printed circuit board has a conductor layer formed in positions facing to the second through-holes;

wherein the pair of second through-holes are arranged point-symmetrically with each other with respect to the center of the first through-hole and are not aligned symmetrically with respect to a line orthogonal to a longitudinal direction of the first through-hole, and are rotated with respect to the longitudinal direction of the first through-hole;

wherein a rotation angle of each of the pair of second through-holes is about 45° with respect to the longitudinal direction of the first through-hole;

wherein the second through-holes have a longitudinal length of about 1.4 times as long as a longitudinal length of the first through-hole; and wherein the dielectric waveguide radiates a circular polarized wave.

2. The dielectric waveguide of claim 1, wherein the second through-holes are disposed away from the center of the first through-hole by a distance less than a half of the wavelength of a frequency to be used.

3. The dielectric waveguide of claim 1, wherein the via hole has a longitudinal length larger than a longitudinal length of the slot, and the first through-hole has a longitudinal length larger than the longitudinal length of the via hole.

* * * * *